US011596581B2

(12) United States Patent
Hall

(10) Patent No.: US 11,596,581 B2
(45) Date of Patent: Mar. 7, 2023

(54) PACIFIER ASSEMBLY DEVICE

(71) Applicant: Nakia Dawn Hall, Owensboro, KY (US)

(72) Inventor: Nakia Dawn Hall, Owensboro, KY (US)

( * ) Notice: Subject to any disclaimer, the term of this patent is extended or adjusted under 35 U.S.C. 154(b) by 187 days.

(21) Appl. No.: 16/514,539

(22) Filed: Jul. 17, 2019

(65) Prior Publication Data

US 2020/0022880 A1 Jan. 23, 2020

Related U.S. Application Data

(60) Provisional application No. 62/699,522, filed on Jul. 17, 2018.

(51) Int. Cl.
*A61J 17/00* (2006.01)

(52) U.S. Cl.
CPC ..... *A61J 17/001* (2015.05)

(58) Field of Classification Search
CPC ..... A61J 17/001; A61J 17/107; A61J 17/113; A61J 17/02; A61J 7/0053; A61J 9/00; A61J 9/005; A61J 17/00; A61J 17/105; A61J 17/1111; A61J 17/111
See application file for complete search history.

(56) References Cited

U.S. PATENT DOCUMENTS 3,601,129 A * 8/1971 Seidl ..... A61J 17/105 606/236
5,211,656 A * 5/1993 Maddocks ..... A61J 17/001 606/236
D430,300 S * 8/2000 Anthony, Jr. ..... D24/194
6,436,125 B1 * 8/2002 Rhoads ..... A61J 17/001 606/234
7,311,721 B2 * 12/2007 Rosuck ..... A61J 17/113 606/234
D646,791 S 10/2011 Pope
D646,792 S * 10/2011 Pope ..... D24/194
9,282,778 B1 * 3/2016 Ingram ..... A42B 1/24
D792,599 S 7/2017 D'Alesio
D883,501 S * 5/2020 Ghuman ..... D24/194
2003/0114865 A1 * 6/2003 Safer ..... A61B 17/0401 606/151
2005/0251211 A1 11/2005 Knifong
2008/0215092 A1 * 9/2008 Smith ..... A61J 17/001 606/236
2009/0192547 A1 * 7/2009 Gates ..... A61J 17/02 606/235
2014/0074165 A1 * 3/2014 Paxson ..... A61J 17/02 606/235
2014/0221917 A1 * 8/2014 Oates, II ..... A61J 7/0053 604/79
2015/0066083 A1 3/2015 Ramos
2016/0184186 A1 6/2016 Montini et al.

FOREIGN PATENT DOCUMENTS

DE 202012002224 5/2012

* cited by examiner

*Primary Examiner* — Dianne Dornbusch
(74) *Attorney, Agent, or Firm* — Valauskas Corder LLC

(57) ABSTRACT

A pacifier assembly device comprising two pacifier components. The pacifier components are assembled together using a connection component. When assembled together, opposing nipple-like protrusions of each pacifier component assists an infant with successfully positioning one of the protrusions into its mouth. When disassembled, the pacifier components may each be used individually or thoroughly cleaned and sanitized.

17 Claims, 5 Drawing Sheets

PACIFIER ASSEMBLY DEVICE

CROSS-REFERENCE TO RELATED APPLICATIONS

This application claims priority to U.S. Provisional Patent Application No. 62/699,522 filed Jul. 17, 2018.

FIELD OF THE INVENTION

The invention relates generally to infant products. More specifically, the invention relates to pacifiers.

BACKGROUND

A pacifier includes an artificial nipple, or teat, that is given to an infant to suck on. Sucking is a natural instinct for infants and is known to soothe them. Typically, a nipple is mounted on one side of a disc-like base and a handle is positioned on the other side of the base. The base covers and extends around the mouth to prevent the infant from accidentally swallowing the pacifier.

A pacifier is provided to infants for a variety of reasons, but most commonly is provided to keep an infant calm or to help an infant sleep. Pacifiers often provide a soothing, calming effect so that a pacifier may comfort a fussy infant.

In addition to keeping an infant calm or helping an infant sleep, there are many other advantages to providing a pacifier to an infant. For example, a pacifier may offer a temporary distraction during and after shots, blood tests or other procedures. Also, a pacifier may ease ear discomfort during flights. Since babies typically can't intentionally "pop" their ears by swallowing or yawning to relieve ear pain caused by air pressure changes, sucking on a pacifier might help. Yet another advantage is that a pacifier might help reduce the risk of sudden infant death syndrome (SIDS).

Conventional pacifiers typically have one nipple. With underdeveloped motor skills limiting the ability for infants to pick-up or grasp items during the early stages of growth, infants tend to grab or hold the nipple since this feature typically is most predominant. As a result, the infant may attempt to position the non-nipple side of the pacifier in their mouth. This causes frustration and prevents the infant from being able to successfully self-soothe, thus negating the advantages of using a pacifier.

Although pacifiers exist such as U.S. Pat. Nos. 3,601,129, 6,436,125, 5,211,656, that have opposing nipples, these devices are constructed as a unitary piece that prevents the opposing nipples from being separated. This complicates manufacturing of the pacifiers and may further present sanitary issues since the unitary piece cannot be disassembled and thoroughly cleaned inside and outside.

What is needed is a pacifier assembly device comprising two pacifier components that provide opposing nipple-like protrusions to assist an infant with successfully positioning one of the protrusions into their mouth. In addition, what is needed is a pacifier assembly device that allows the two pacifier components to be separated from one another so that each component may be used separately and each component thoroughly cleaned and sanitized. The invention satisfies this need.

SUMMARY OF THE INVENTION

The invention is directed to a pacifier assembly device that comprises two pacifier components that may be used individually or assembled together. When assembled together, opposing nipple-like protrusions of each pacifier component assist an infant in successfully positioning one of the protrusions into their mouth. Since the pacifier device according to the invention does not include a side without a nipple protrusion, the infant can always find a nipple protrusion to place in their mouth.

The pacifier components also are easily disassembled from each other. Disassembly of the pacifier components allows each pacifier component to be thoroughly cleaned and sanitized. Disassembly of the pacifier components also allows each pacifier component to be used individually.

Furthermore, manufacturing of the components of the invention is simplified by providing two identical pacifier components that can be molded, 3D printed, machined, or casted.

Each pacifier component may comprise a mouthguard or base portion with two sides. A nipple-like protrusion may be positioned on one side of the mouthguard portion. The mouthguard portion may be firmly attached to the nipple-like protrusion to prevent ingestion of the protrusion. The nipple-like protrusion may be solid or hollow.

A connection component may be positioned on the opposite side of the mouthguard portion. Each connection component may comprise a mortise portion and a tenon portion. The mortise portion and tenon portion of a first pacifier component are each configured to cooperate with a tenon portion and a mortise portion, respectively, of a second pacifier component.

The mouthguard portion may further include one or more aperture elements. Each aperture element may extend through both sides of the mouthguard portion and used as a handle by the infant to grasp and manage one of the pacifier components or the assembled device. The aperture elements also may be used with existing clips or holders.

The invention and its attributes and advantages may be further understood and appreciated with reference to the detailed description below of one contemplated embodiment, taken in conjunction with the accompanying drawings.

DESCRIPTION OF THE DRAWING

The accompanying drawings, which are incorporated in and constitute a part of this specification, illustrate an implementation of the invention and, together with the description, serve to explain the advantages and principles of the invention.

DETAILED DESCRIPTION OF THE INVENTION

The invention is directed to a pacifier assembly device comprising two pacifier components that may be used individually or assembled together. Each pacifier component may be constructed of any material or combination of materials, for example, latex, silicone, plastic, rubber, or polymer, but any material is contemplated.

Figure 1:
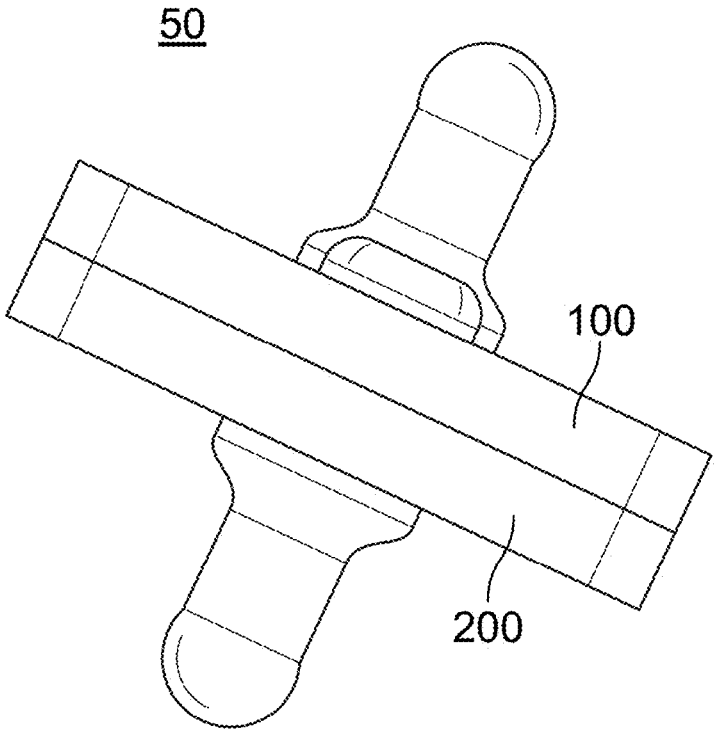
FIG. 1 is a perspective view of an assembled pacifier device according to an embodiment of the invention.

FIG. 1 is a perspective view of an assembled pacifier device 50 according to an embodiment of the invention. The pacifier assembly device 50 comprises a first pacifier component 100 and a second pacifier component 200. The first pacifier component 100 and second pacifier component 200 are identical in structure.

Figure 2:
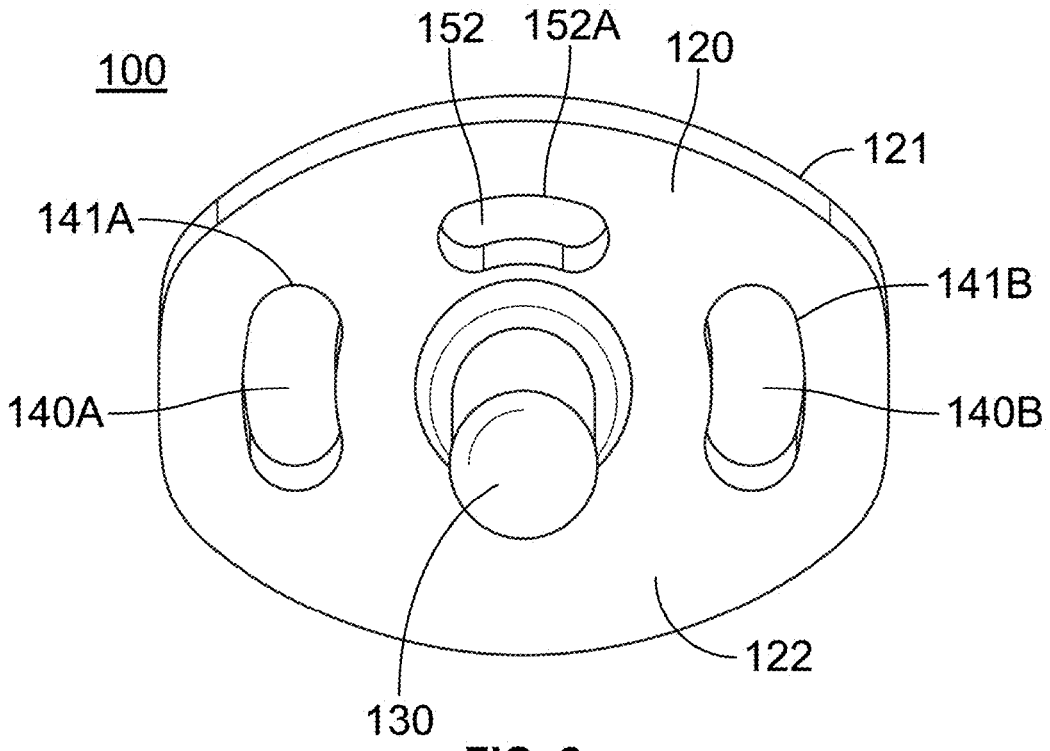
FIG. 2 is a front view of a first pacifier component according to the invention.
Figure 3:
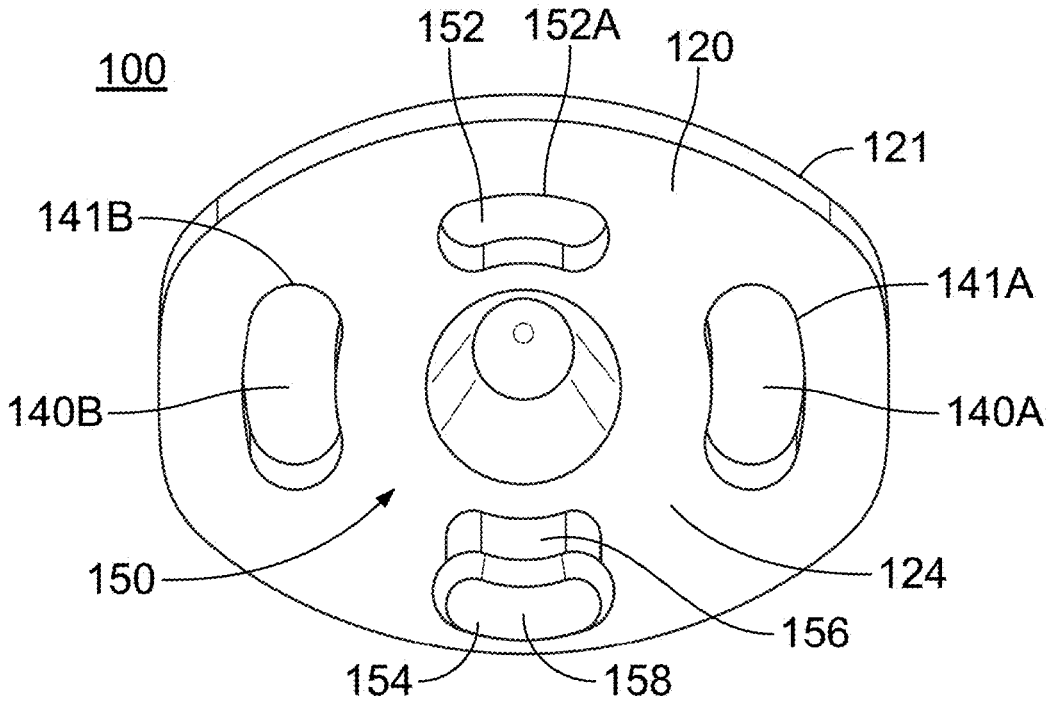
FIG. 3 is a rear view of a first pacifier component according to the invention.

FIG. 2 and FIG. 3 illustrate a front and rear view, respectively, of a first pacifier component 100. The first pacifier component 100 includes a first mouthguard portion 120 defined by a first border surface 121, a first front side 122, and a rear side 124.

A first nipple-like protrusion 130 is positioned on the first front side 122 of the first mouthguard portion 120. The nipple-like protrusion 130 is located generally in the center of the mouthguard portion 120.

The first mouthguard portion 120 includes one or more aperture elements 140A, 140B. Each aperture element 140A, 140B may extend through both sides 122, 124 of the first mouthguard portion 120 and may be used as a handle by the infant to grasp and manage the pacifier component 100 or the assembly device 50. It is also contemplated that the aperture elements 140A, 140B may also be used with existing clips or holders.

Aperture elements 140A, 140B each are positioned between the nipple-like protrusion 130 and first border surface 121. Aperture element 140A is defined by a boundary surface 141A and aperture element 140B is defined by a boundary surface 141B. The boundary surface 141A, 141B each define the size and shape of the aperture elements 140A, 140B of which any size and shape is contemplated, for example, oval, circular, or rectangular, that may accommodate the fingers of an infant or existing clips or holders.

A first connection component 150 is located on the rear side 124 of the first pacifier component 100. The connection component 150 comprises a mortise portion 152 and a tenon portion 154. The size and shape of the first mortise portion 152 is defined by first edge surface 152A. The first mortise portion 152 may be an aperture extending through both sides 122, 124 of the first pacifier component 100. The tenon portion 154 may comprise a flange element 156 that projects perpendicularly from the rear side 124 of the mouthguard portion 120. The end of the flange element 156 may include a protuberance element 158.

Figure 4:
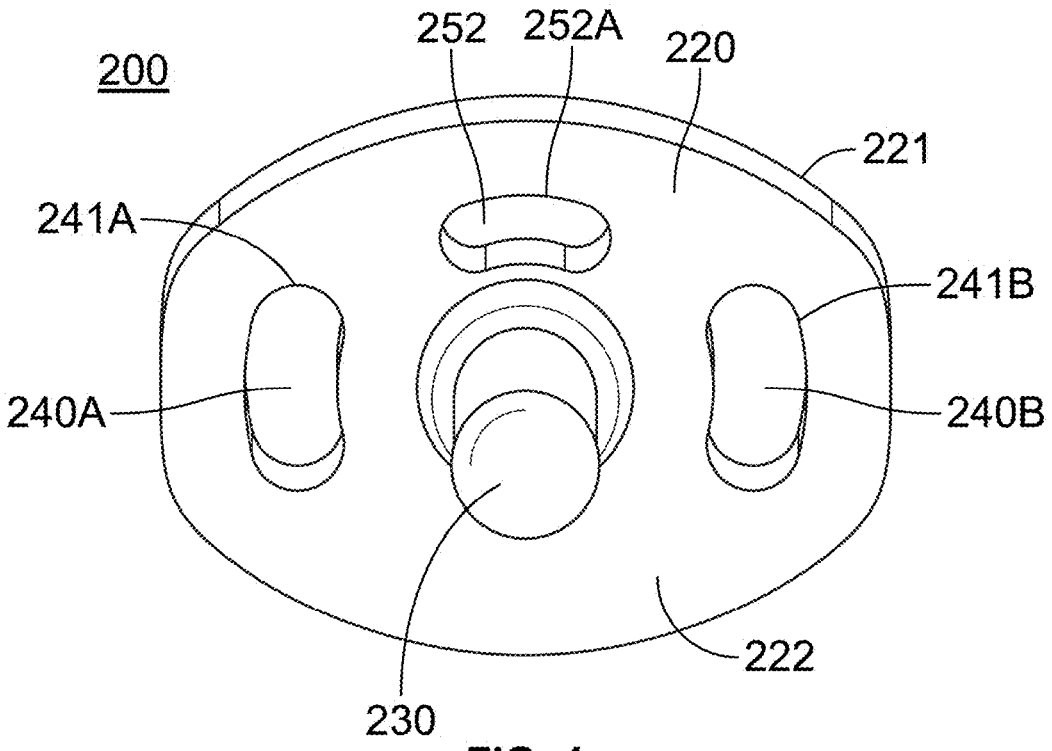
FIG. 4 is a front view of a second pacifier component according to the invention.
Figure 5:
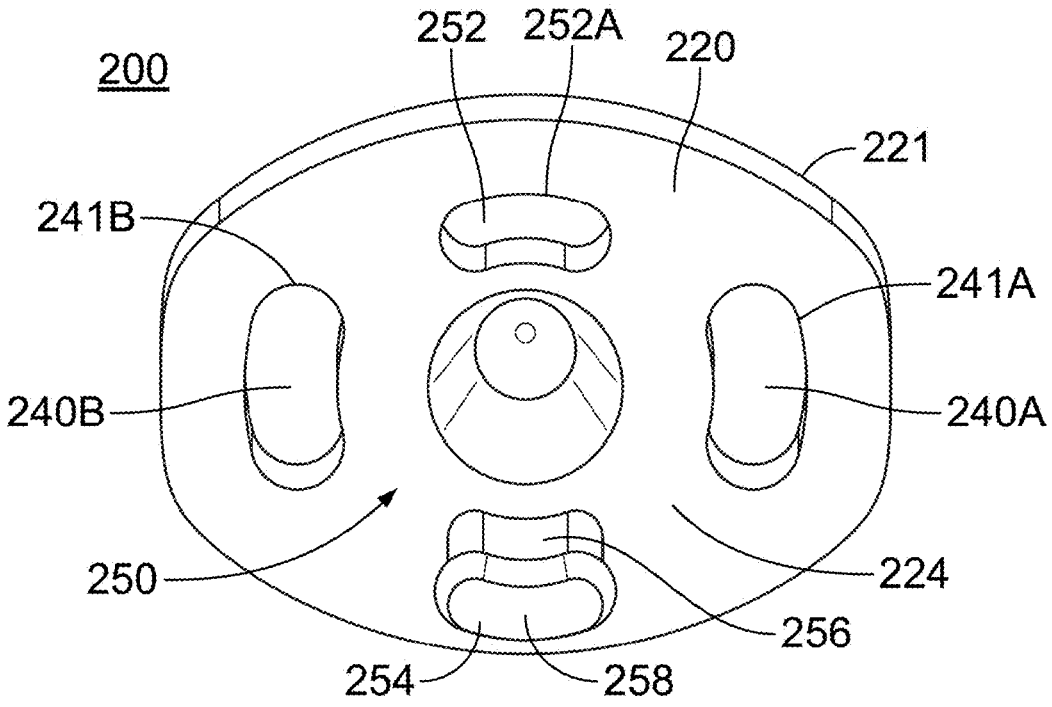
FIG. 5 is a rear view of a second pacifier component according to the invention.

FIG. 4 is a front view of a second pacifier component 200 and FIG. 5 is a rear view of the second pacifier component 200. The second pacifier component 200 includes a second mouthguard portion 220 defined by a second border surface 221. The second mouthguard portion 220 comprises further a second front side 222 and a second rear side 224.

A second nipple-like protrusion 230 may be positioned on the second front side 222 of the second mouthguard portion 220. The nipple-like protrusion 230 may be located generally in the center of the second mouthguard portion 220.

The second mouthguard portion 220 includes further one or more aperture elements 240A, 240B. Each aperture element 240A, 240B may extend through both sides 222, 224 of the second mouthguard portion 220 and used as a handle by the infant to grasp and manage the pacifier component 200 or the assembly device 50. Aperture elements 240A, 240B also may be used with existing clips or holders.

Aperture elements 240A, 240B are each positioned between the nipple-like protrusion 230 and second border surface 221. Aperture element 240A is defined by a boundary surface 241A and aperture element 240B is defined by a boundary surface 241B. The boundary surface 241A, 241B each define the size and shape of the aperture elements 240A, 240B of which any size and shape is contemplated, for example, oval, circular, or rectangular, that may accommodate the fingers of an infant or existing clips or holders.

A second connection component 250 is located on the second rear side 224 of the second pacifier component 200. The second connection component 250 comprises a second mortise portion 252 and a second tenon portion 254. The size and shape of the second mortise portion 252 is defined by second edge surface 252A. The second mortise portion 252 may be an aperture extending through both sides 222, 224 of the second pacifier component 200. The second tenon portion 254 comprises a second flange element 256 that projects perpendicularly from the second rear side 224 of the second mouthguard portion 220. The end of the second flange element 256 may include a protuberance element 258.

Figure 6:
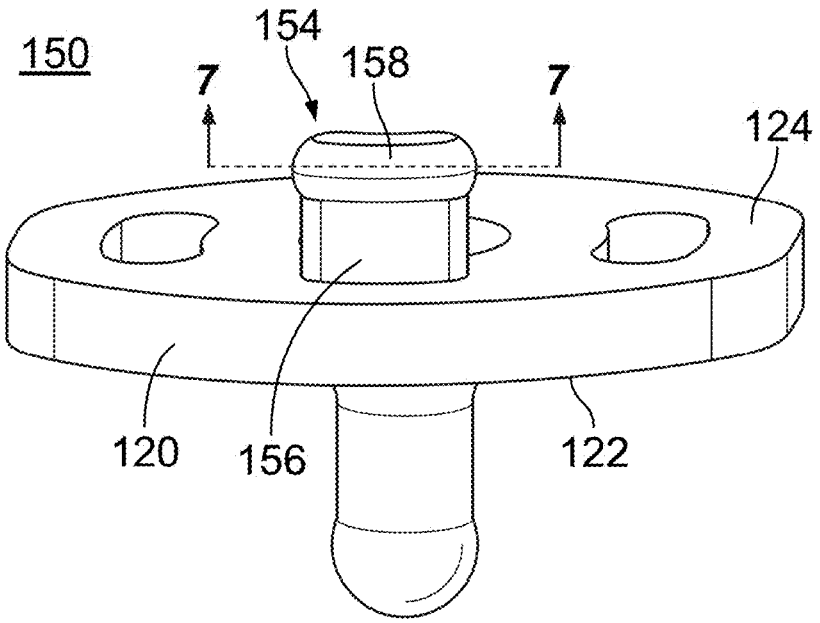
FIG. 6 is a side view of a connection component according to the invention.

As mentioned above, the first connection component 150 and second connection component 250 are identical in structure. As shown in FIG. 6, the connection component 150 includes a tenon portion 154 comprising a flange element 156 that projects perpendicularly from the rear side 124 of the first mouthguard portion 120 of the first pacifier component 100. The end of the first flange element 156 includes a first protuberance element 158.

The first connection component 150 of the first pacifier component 100 is configured to cooperate with the second connection component 250 of the second pacifier component 200. More specifically, the first mortise portion 152 and first tenon portion 154 of a first pacifier component 100 each are configured to cooperate with a tenon portion 254 and a second mortise portion 252, respectively, of a second pacifier component 200 in order to secure together a complete pacifier assembly device 50.

Figure 7:
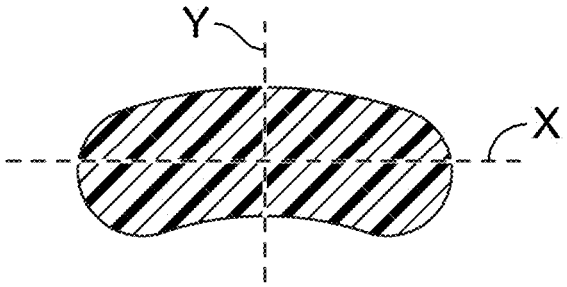
FIG. 7 is a cross-sectional view of a portion of the connection component according to an embodiment of the invention.

In a preferred embodiment, both the mortise portion 152 and the protuberance element 158 are U-shaped, or shaped to resemble a kidney bean ("bean-shape"). FIG. 7 illustrates a cross-sectional view of the protuberance element 158. Although any shaped mortise portion and protuberance portion is contemplated, a bean-shape prevents the) tenon portion from pulling out of the mortise portion during use. When an infant is sucking on a nipple-like protrusion of a first pacifier component, the corresponding mouthguard portion will be pulled toward the infant causing separation from the mouthguard portion of the second pacifier component. However, the tenon portion of the second pacifier component forces the second pacifier component to travel with the first pacifier component during the sucking motion in order to minimizing or eliminate separation of the pacifier components. This also may prevent unwanted debris from settling on surfaces between the pacifier components. More specifically, U-shaped protuberance elements are curved about the y-axis (defined by the cross section as shown in FIG. 7) so that they each bend toward the nipple-like protrusion respectively, thereby enabling flexibility of the nipple-like protrusion.

Figure 8:
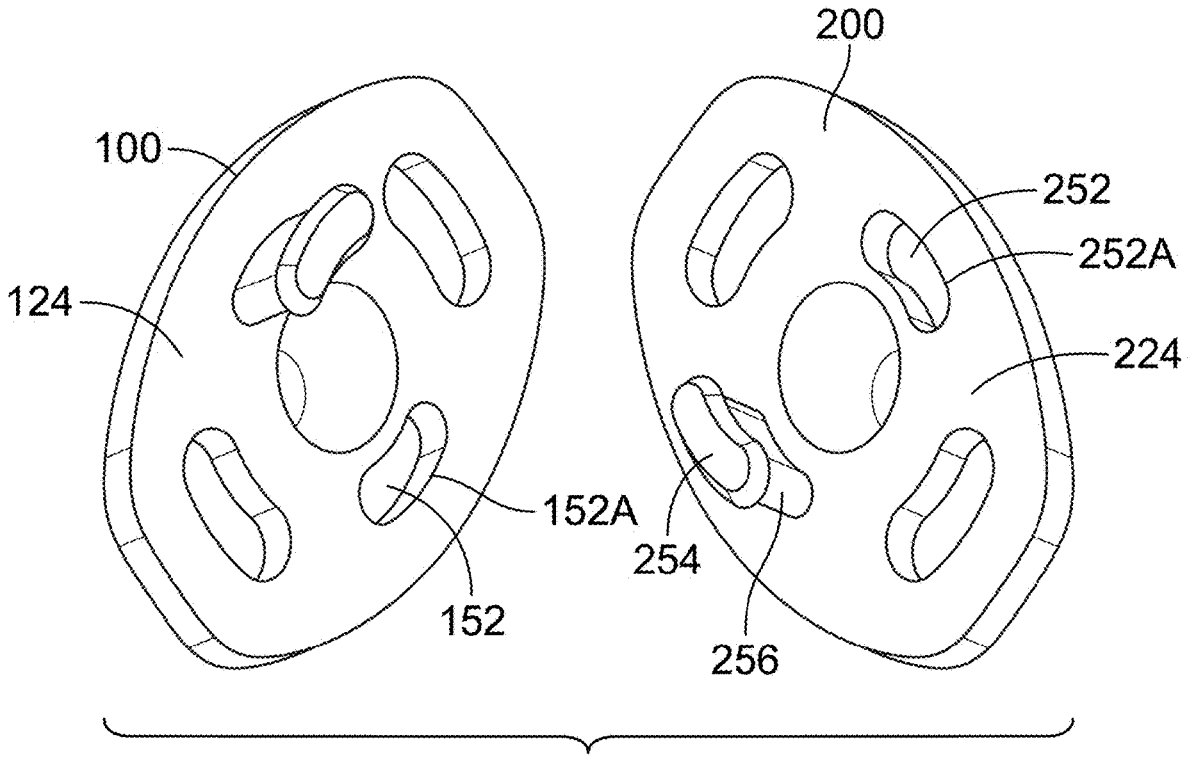
FIG. 8 is a perspective view of a disassembled pacifier device according to an embodiment of the invention.
Figure 9:
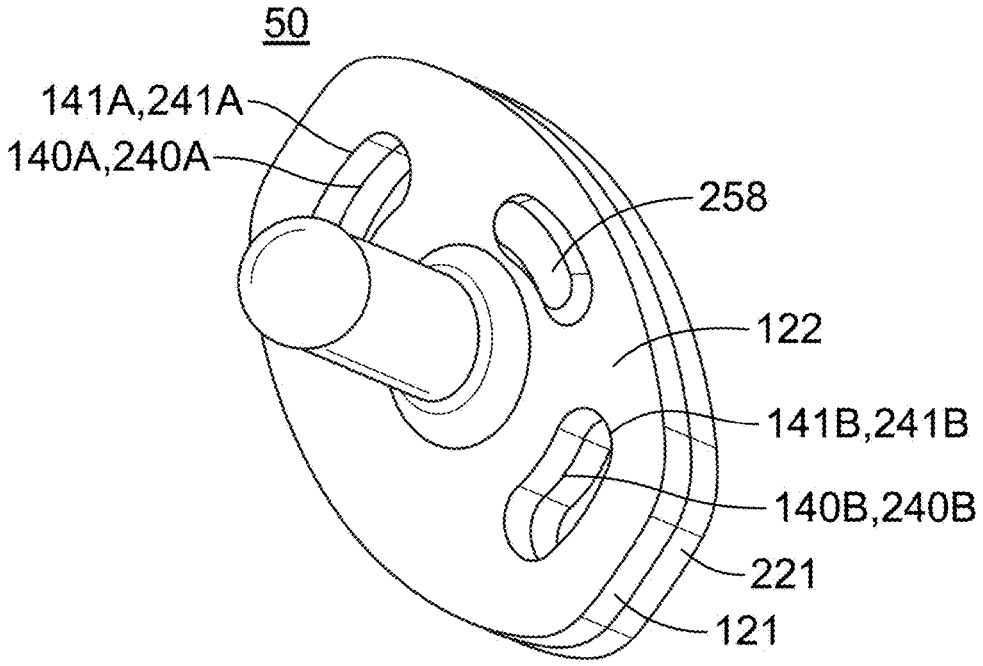
FIG. 9 is a perspective view of an assembled pacifier device according to an embodiment of the invention.

FIG. 8 is a perspective view of a disassembled pacifier device according to an embodiment of the invention and FIG. 9 is a perspective view of an assembled pacifier device according to an embodiment of the invention.

The first pacifier component 100 and second pacifier component 200 are assembled together such that the first rear side 124 touches the second rear side 224. The first mortise portion 152 receives, or connects to, the second tenon portion 254. When assembled, the second flange element 256 abuts the edge surface 152A and the second protuberance element 258 is located on the first front side 122. Similarly, the second mortise portion 252 receives, or connects to, the first tenon portion 154. When assembled, the first flange element 156 abuts the edge surface 252A and the first protuberance element 158 is located on the second front side 222.

As shown in FIG. 9, the pacifier device 50 is assembled so that the first border surface 121 and the second border surface 221 are aligned. Furthermore, boundary surfaces 141A, 241A are aligned so that aperture elements 140A, 240A form a through-hole. Similarly, boundary surfaces 141B, 241B are aligned so that aperture elements 140B, 240B form a through-hole.

Although the pacifier assembly device is illustrated with two connection elements, it is contemplated that the invention may only use one connection element to connect the first pacifier component and the second pacifier component. However, this embodiment does not provide two pacifier components that are identical in structure.

The described embodiments are to be considered in all respects only as illustrative and not restrictive, and the scope of the invention is not limited to the foregoing description. Those of skill in the art may recognize changes, substitutions, adaptations and other modifications that may nonetheless come within the scope of the invention and range of the invention.

The invention claimed is:

1. A pacifier assembly device including components configured to be used individually or assembled, the device comprising:

a first pacifier component, the first pacifier component comprising a first mouthguard portion defined by a first front side surface, a first rear side surface, and a first border surface, a first flange element projecting perpendicularly from the first rear side surface, a first aperture extending through both the first front side surface and the first rear side surface, a first nipple-like protrusion projecting perpendicularly from the first front side surface;

a second pacifier component, the second pacifier component comprising a second mouthguard portion defined by a second front side surface, a second rear side surface, and a second border surface, a second flange element projecting perpendicularly from the second rear side surface, a second aperture extending through both the second front side surface and the second rear side surface, a second nipple-like protrusion projecting perpendicularly from the second front side surface;

the first pacifier component and the second pacifier component configured to attach non-permanently together, wherein the second flange element assembles to the first aperture so that the second flange element protrudes through both the first front side surface and the first rear side surface of the first pacifier component, and the first flange element assembles to the second aperture so that the first flange element protrudes through both the second front side surface and the second rear side surface of the second pacifier component such that the first nipple-like protrusion of the first pacifier component opposes the second nipple-like protrusion of the second pacifier component.

2. The pacifier assembly device according to claim 1, wherein each of the first aperture and the second aperture is U-shaped.

3. The pacifier assembly device according to claim 1, wherein the first flange element terminates with a first protuberance element and the second flange element terminates with a second protuberance element.

4. The pacifier assembly device according to claim 3, wherein a cross-sectional shape of the first protuberance element and the second protuberance element is U-shaped.

5. The pacifier assembly device according to claim 4, wherein the cross-sectional shape of each of the first protuberance element and the second protuberance element is curved about the y-axis to bend toward the nipple-like protrusion.

6. The pacifier assembly device according to claim 3, wherein the first pacifier component and the second pacifier component are connected together with the second aperture receiving the first protuberance element of the first flange element and the first aperture receiving the second protuberance element of the second flange element.

7. The pacifier assembly device according to claim 1, wherein each pacifier component further comprises aperture elements, the aperture elements positioned between the nipple-like protrusion and the border surface of each pacifier component.

8. A pacifier assembly device including components configured to be used individually or assembled, the device comprising:

a first pacifier component comprising a first nipple-like protrusion on a first front side surface, a first tenon portion on a first rear side surface, and a first mortise portion comprising a first aperture;

a second pacifier component comprising a second nipple-like protrusion on a second front side surface, a second tenon portion on a second rear side surface, and a second mortise portion comprising a second aperture;

the first pacifier component non-permanently attached to the second pacifier component, wherein the first tenon portion is assembled to the second mortise portion so that the first tenon portion protrudes through both the second front side surface and the second rear side surface of the second pacifier component, and the second tenon portion is assembled to the first mortise portion so that the second tenon portion protrudes through both the first front side surface and the first rear side surface of the first pacifier component, and further wherein the first nipple-like protrusion of the first pacifier component opposes the second nipple-like protrusion of the second pacifier component.

9. The pacifier assembly device according to claim 8, wherein the first mortise portion is kidney bean-shaped.

10. The pacifier assembly device according to claim 8, wherein the second mortise portion is kidney bean-shaped.

11. The pacifier assembly device according to claim 8, wherein the first tenon portion comprises a first flange element and a first protuberance element.

12. The pacifier assembly device according to claim 11, wherein a cross-sectional shape of the first protuberance element is kidney bean-shaped.

13. The pacifier assembly device according to claim 8, wherein the second tenon portion comprises a second flange element and a second protuberance element.

14. The pacifier assembly device according to claim 13, wherein a cross-sectional shape of the second protuberance element is kidney bean-shaped.

15. A pacifier assembly device including components configured to be used individually or assembled, the device comprising:

a first pacifier component comprising:

a first front side and a first rear side, a first mortise portion comprising an aperture defined by a first edge surface, a first tenon portion located on the first rear side, the first tenon portion comprising a first flange element terminating with a first protuberance element, and a first nipple protrusion projecting perpendicularly from the first front side;

a second pacifier component comprising:

a second front side and a second rear side, a second mortise portion comprising an aperture defined by a second edge surface, a second tenon portion located on the second rear side, the second tenon portion comprising a second flange element terminating with a second protuberance element, and a second nipple protrusion projecting perpendicularly from the second front side, wherein each pacifier component further comprises aperture elements;

the first pacifier component non-permanently attached to the second pacifier component, wherein the first mortise portion connects to the second tenon portion with the second protuberance element protruding through both the first front side and the first rear side of the first pacifier component, and the second mortise portion connects to the first tenon portion with the first protuberance element protruding through both the second front side and the second rear side of the second pacifier component, such that the first nipple-like protrusion of the first pacifier component opposes the second nipple-like protrusion of the second pacifier component.

16. The pacifier assembly device according to claim 15, wherein both the first mortise portion and the second mortise portion is U-shaped.

17. The pacifier assembly device according to claim 15, wherein a cross-sectional shape of both the first protuberance element and the second protuberance element is U-shaped.

* * * * *